US005223365A

United States Patent [19]

Yamamoto et al.

[11] Patent Number: 5,223,365

[45] Date of Patent: Jun. 29, 1993

[54] MAGNETIC TONER

[75] Inventors: Yoko Yamamoto; Hirohiko Seki; Hiroshi Yamazaki, all of Hachioji, Japan

[73] Assignee: Konica Corporation, Tokyo, Japan

[21] Appl. No.: 452,555

[22] Filed: Dec. 18, 1989

[30] Foreign Application Priority Data

Dec. 19, 1988 [JP] Japan ..... 63-321524

[51] Int. Cl.[5] ..... G03G 9/083; G03G 9/107; G03G 9/00; G03G 5/00

[52] U.S. Cl. ..... 430/106.6; 430/111; 430/137; 430/903

[58] Field of Search ..... 430/137, 111, 110, 106.6, 430/903

[56] References Cited

U.S. PATENT DOCUMENTS

| | | | |
|---|---|---|---|
| 4,381,359 | 4/1983 | Idel et al. | 524/117 |
| 4,680,371 | 7/1987 | Rosenfeld | 528/179 |
| 4,762,765 | 8/1988 | Nied et al. | 430/137 |
| 4,835,082 | 5/1989 | Koishi et al. | 430/137 |
| 4,900,647 | 2/1990 | Hikake et al. | 430/137 |
| 4,906,547 | 3/1990 | Tavernier et al. | 430/106.6 |
| 4,915,987 | 4/1990 | Nara et al. | 427/180 |
| 5,110,881 | 5/1992 | McBain | 525/455 |

FOREIGN PATENT DOCUMENTS

| | | | |
|---|---|---|---|
| 0453149 | 10/1991 | European Pat. Off. . | |
| 52-18459 | 12/1984 | Japan | 430/111 |
| 61-171709 | 8/1986 | Japan . | |
| 3235953 | 9/1988 | Japan . | |

OTHER PUBLICATIONS

"Statement of Qualifications and Experience, Soil Wash System", Geraghty & Miller, Inc. and Heidemij Reststoffendiensten B.V.

Patent Abstracts of Japan, vol. 9 No. 269 (P-400) [1992]; Oct. 16, 1985 JPA 60-117255; Jun. 24, 1985.

Patent Abstracts of Japan, vol. 13 No. 70 (P-829) [3418]; Feb. 17, 1989 JPA 63-256967; Oct. 24, 1988.

*Primary Examiner*—Marion E. McCamish
*Assistant Examiner*—Stephen Crossan
*Attorney, Agent, or Firm*—Jordan B. Bierman

[57] ABSTRACT

The improved toner is produced by supplying a spheroidizing treatment under mechanical impact force to resin particles that contain at least magnetic particles in a resin and said magnetic particles are substantially spherical in shape.

7 Claims, 1 Drawing Sheet

MAGNETIC TONER

BACKGROUND OF THE INVENTION

The present invention relates to a magnetic toner for use in developing latent electrostatic image formed in electrophotography, electrostatic recording, electrostatic printing, etc. More particularly, the present invention relates to a magnetic toner comprised of spheroidized particles.

The process of electrophotography generally comprises the following steps: providing a uniform electrostatic charge layer on the surface of a photoreceptor having a light-sensitive layer made of a photoconductive material; performing imagewise exposure to form a latent electrostatic image on the surface of the photoreceptor; developing the latent electrostatic image with a developer to form a toner image; transferring the toner image onto a receiving sheet such as paper; and fixing the transferred image either with heat or under pressure to form a copy image.

Dry developers used in the development step are generally classified as a two-component developer composed of a non-magnetic toner containing no magnetic material and a magnetic carrier, and a one-component developer formed of a magnetic toner containing a magnetic material. Of these two types, a one-component developer formed of a magnetic toner is preferred since toner density need not be adjusted and because the construction of a developing unit can be simplified.

Magnetic toner is usually transported to the developing area as it is carried on a sleeve by magnetism. If the magnetic toner particles have an irregular shape, the direction of their magnetization will not become uniform and difficulty is encountered in forming a developer layer of uniform density and thickness on the sleeve. The irregularly shaped toner particles have low fluidity and when supplied into the developing unit from above, they form a cap in the upper part of the developing unit creating a hollow inner portion. This phenomenon generally called "cavitation" renders the toner transport instable.

Further, magnetic toner particles that are irregularly shaped have many asperities on their surface and the area of frictional contact with the sleeve surface is insufficient to achieve rapid triboelectrification. This contributes to an increase in the proportion of weakly charged toner particles or those which have reverse polarity. As a result, fogging or fringing will occur in the toner image on the photoreceptor, and the reproduction of fine lines in the fixed image will be impaired. The term "fringing" as used herein means a phenomenon in which an unwanted toner which in chiefly composed of particles of reverse polarity is deposited in the non-image areas in the neighborhood of the latent electrostatic image on the photoreceptor. If fringing occurs, the consumption of toner particles that do more harm than good increases to render economical image formation difficult. Further, the image formed is incapable of faithful reproduction of fine lines. In addition, a substantial portion of toner particles of reverse polarity tends to remain on the photoreceptor without being transferred onto the receiving sheet and this increases the load on the cleaning device so greatly as to cause occasional insufficient cleaning.

In order to solve these problems, the triboelectrification of toner particles must be controlled and spheroidizing them is useful for this purpose. Various techniques have so far been proposed for producing spheroidized magnetic toner particles and they include the following:

(1) the surfaces of particles prepared by kneading, powdering and classifying steps are melted by hot air or other means using a spray dryer to obtain spheroidized particles (Unexamined Published Japanese Patent Application Nos. 56-52758 and 59-127662);

(2) the particles prepared by kneading, powdering and classifying steps are dispersed in a hot air stream and their surfaces are melted to obtain spheroidized particles (Unexamined Published Japanese Patent Application No. 58-134650);

(3) the particles prepared by kneading and coarse grinding are subjected to a fine grinding step while at the same time, the temperature of air flowing in is controlled to obtain spheroidized particles (Unexamined Published Japanese Patent Application No. 61-61627);

(4) granulation polymerization (Unexamined Published Japanese Patent Application No. 56-121048); and (5) the particles prepared by kneading, powdering and classifying steps are effectively spheroidized by cyclic application of mechanical energy under impact force in a gas phase (Japanese Patent Application No. 62-68001).

In the first three methods, heat cannot be applied uniformly to all of the particles to be spheroidized and the melted particles will have an irregular shape or surface state. Further, the heated particles have a tendency to fuse together and the proportion of coarse particles will increase. As a result, the spheroidized particles will not be uniform in shape and size and in order to bring the distribution of their size into a desired one, another step of classification is necessary. Thus, it has been difficult to produce magnetic toners in high yield by methods (1) to (3). If unclassified particles having a broad size distribution are immediately used as toner, not only insufficiency or unevenness will occur in the density of the black solid area but also the image area composed of characters will suffer jumps, blocking of shadows, fogging and other problems.

In order to improve the efficiency of fixing with heated rollers, it is useful to incorporate waxes in magnetic toner particles. However, if particles containing waxes are thermally melted for spheroidization, the waxes will bleed on the molten surfaces by different degrees and it often occurs that the surface characteristics of individual particles have different levels in triboelectric series. Because of this nonuniformity in triboelectrification property, toner particles will not only be electrified in opposite polarity with respect to one another but they are also electrified weakly or in reverse polarity with respect to the sleeve. This causes instability in development and consequent fringing will increase the amount of toner particles that remain on the photoreceptor and which increase the load on the cleaning device to such a level that insufficient cleaning will often result. Further, concentrated fringes around fine lines will impair the reproducibility of character image.

The granulation polymerization technique adopted in the fourth method suffers the disadvantage of limited scope of applicable binder resins. Further, the toner production process takes a prolonged time and hence results in low yield.

The fifth method on which the present invention is an improvement has the following advantages:

i) in the absence of heating, toner particles will not fuse together during spheroidization;

ii) a wax will not bleed on the surface of toner particles;

iii) toner particles of reverse polarity will not be formed in large amounts; and iv) short production time.

On the other hand, a major disadvantage of this method is that unduly fine particles and free magnetic particles will be generated because of crushing by mechanical energy.

If mechanical energy is applied to resin particles, they are not only spheroidized but also crushed into fine particles. With a one-component developer, small toner particles have a higher developing ability than large particles, so the fine particles produced will be a major factor that contributes to fogging in the initial period of use of a fresh developer. They also cause the toner particles to fly about in the developing device. Furthermore, if magnetic particles resulting from the crushing process are built up on the sleeve, insufficient toner transport will cause either uneven density or the formation of white streaks.

Developability or fogging can be controlled by adjusting the developing bias but it is by no means easy to broaden the range over which the developing bias can be adjusted since it requires a higher performance and hence costly device. Fine particles could be partly removed by performing classification after the spheroidization process but not all of them can be removed by this technique. On the contrary, the additional step of classification results in a lower yield and contributes to an increase in the production cost of developer through immediate increase in the running cost. If the impact energy applied for spheroidization is reduced to an extremely low level with a view to preventing the formation of fine particles, uniform and thorough spheroidization cannot be accomplished.

SUMMARY OF THE INVENTION

An object, therefore, of the present invention is to provide a magnetic toner that produces high-quality image without fogging, that can be transported efficiently without flying about, and that yet can be produced at high rate and at low cost without need for a final classification step.

The magnetic toner contemplated by the present invention is of a type that is produced by applying a spheroidizing treatment under mechanical impact force to resin particles that contain at least magnetic particles in a resin. The above-stated object of the present invention can be attained by using substantially spherical magnetic particles in the resin.

BRIEF DESCRIPTION OF THE DRAWING

In FIG. 1. 1 is a casing; 2 is a shooter for throwing starting materials: 3 is a circulation path; 4 is flying and collision track of powder particles: 5 is a jacket (for cooling or heating); 6 is a stator; 7 is a blade; 8 is a rotating disk; 9 is a valve for exhausting modified and capsuled powder; and 10 is a shooter for exhausting modified and capsuled powder.

DETAILED DESCRIPTION OF THE INVENTION

Figure 1:
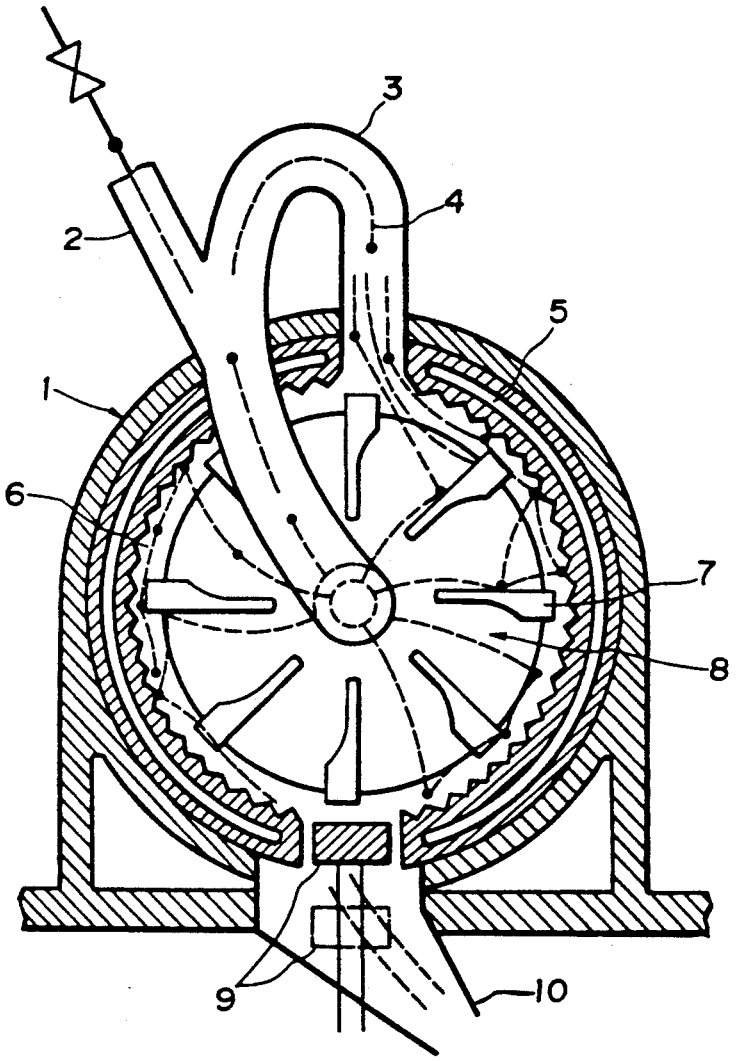
FIG. 1 is a side view showing the operation of a plastic spheroidizing apparatus for use in the present invention.

The term "substantially spheric" as used herein means that the magnetic particles of interest have a shape that is visually discernible as spherical by observation under an electron microscope or other device. Preferably, these magnetic particles have a minor to major axis ratio of at least 0.9.

The magnetic particles to be used in the present invention may be present as cores in resin particles; alternatively, they may be suspended or dispersed in the resin. The surfaces of magnetic particles generally are not smooth but are irregular with many asperities. If such particles wet poorly with the resin with which they are to be kneaded, cavities that are not readily removable will form in recesses and other portions of the magnetic particles. stresses developing in the resin particles will be concentrated in these cavities which serve as the starting point for the development of cracks in the resin which is a solid (or rigid) material. Upon repeated impact application, the cranks will grow until the resin fractures. If the impact is to be applied repeatedly, only a very small force will suffice to cause fracture of the solid material.

In the process of spheroidization by impact force according to the present invention, a bulk magnetic toner powder that has been subjected to kneading and grinding operations is blown into the spheroidizing apparatus as they suspended and fluidized in air. The magnetic particles are allowed to impinge violently on the blades mounted on a rapidly rotating disk. As a result of this impingement, the particles are spheroidized and subjected to a breaking force.

The present inventors studied these phenomena rheologically and assumed that the resin particles which were to be subjected to impact force were no longer rigid but would rather behave as plastic particles. It should, however, be noted here that depending on the direction in which the particles are suspended or they fly, the force of impact on the particles that results from the sum of vectors will vary over a certain range. Hence, depending upon the intensity of impact force, the bulk magnetic toner particles would be subjected to a force that is a mixtures of plastic deformation and fracture.

The magnetic particles to be used in the present invention have a smaller specific surface area than irregularly shaped ones, so they have better wettability with binder resins and have no sites for withdrawing cavities where stresses will be concentrated on the magnetic material. They also have no sites where cavities will be formed again during kneading and other steps. Further, the magnetic particles will be dispersed efficiently in the resin during the kneading step to provide a homogeneous toner component, which will resist fracture and the formation of free magnetic particles since no stress concentration will occur even if repeated impact is exerted during the spheroidization process.

During the kneading step, the powder of a binder resin is kneaded in a molten state and a large amount of air bubbles will be entrapped within the mixture. If a resin powder is heated in the presence of many air containing voids between individual particles, the resin becomes molten with the inter-particle air being left substantially intact without escaping from the resin even if it is kneaded with magnetic particles.

If a sufficiently high energy is imparted to perform effective grinding, the air bubbles confined between resin particles serve as points of stress concentration to accelerate resin breaking and hence improve the efficiency of its pulverization. Thus, there is no particular need for performing deaeration in the kneading step. However, depending on the way air bubbles are deposited on the surfaces of magnetic particles, different effects will result from repeated application of mechanical impact during the spheroidization process. The resin and magnetic material in toner particles have different elastic moduli by nature and under a given load, the resin will deform more than the magnetic material and if there are air bubbles at the interface between the resin and the magnetic material or if the magnetic material is unevenly dispersed in the resin, an extremely large stress will be concentrated at the interface between the resin, magnetic material and air bubbles. Further, if the magnetic material is directly subjected to the force of impact exerted by blades, the magnetic particles will undergo momentary displacement and an even greater stress will be concentrated to destroy toner particles. On the other hand, spherical magnetic particles by themselves have high strength against external forces and stresses, if applied at all, will be dispersed rather than concentrated. Thus, resin particles having such spherical magnetic particles dispersed therein uniformly are highly resistant to fracture and the externally applied energy will be effectively used to spheroidize the resin particles.

As described above, the presence or absence of air bubbles that are deposited on the surface of magnetic particles and the uniformity of dispersion of magnetic particles in binder resins are two important factors that govern the probability of the generation of fine toner particles. In other words, a bulk magnetic toner powder containing spherical magnetic particles in accordance with the present invention can be treated by a mechanical spheroidizing process (herein referred to as a "plastic spheroidizing process") without generating fine particles and the magnetic toner that has passed through the plastic spheroidizing process need not be subjected to a classifying step for removing fine particles. Further, the problems associated with image quality and those to be encountered in copying operations are already dissolved by the present invention. These consequences which are natural to the present invention are very useful and magnetic toners of good quality can be produced efficiently and at low cost.

Further, taken as a whole, the particles will become increasingly spherical as they are subjected to repeated plastic deformation, and the consequent improvement in the fluidity and triboelectricity of the magnetic toner contributes homogeneity in the triboelectric series of its surface, thereby eliminating the chance of electrification in reverse polarity.

The toner particles of the present invention preferably have a sphericity in the range of 0.4–0.8 as expressed by Wadell's true sphericity, Ψ, which is defined by:

$$\Psi = \frac{\text{theoretical specific surface area of an assumed sphere}}{\text{specific surface area as measured by } BET \text{ method}}$$

The plastic spheroidization process may be performed in the present invention by means of commercial apparatus such as "Hybridization System" available from Nara Kikai Co., Ltd. or "Turbo Mill" from Turbo Kogyo Co, Ltd. The "Hybridization System" is shown schematically in FIG. 1. As shown, blades are mounted on a rotating disk, which rotates rapidly to allow the toner particles in a circulating air stream to impinge violently on the blades. The energy of the resulting impact provides projections on toner particles with the force of plastic deformation which smooths the surfaces of toner particles, thereby rendering the toner particles to have a generally spherical shape.

The amount of impact energy need be adjusted depending upon the starting material.

The toner binder resin for use in the present invention is selected in consideration of various factors such as polarity of chargeability, transferrability, fixability with heat or under pressure, cleanability, storage stability and endurance. Specific examples of binder resins that can be used include homo- or copolymers of styrene and substituted styrenes such as polystyrene, styrene-maleic anhydride copolymer, styrene-acrylic copolymers and styrene-butadiene copolymer, as well as polyvinyl acetate, polyester resins, acrylic resins, epoxy resins, polyamide resins, etc.

The magnetic material to be contained in the magnetic toner may be selected from among those materials which are magnetized predominantly in a direction parallel to that of an applied magnetic field. Suitable examples are ferromagnetic metals such as iron, nickel and cobalt, as well alloys and compounds containing these metals such as ferrite and magnetite.

In preparing resin particles, additives such as charge control agents and release agents may optionally be used in addition to the above-mentioned binder resins and magnetic particles. Illustrative charge control agents include nigrosine, azo, quaternary ammonium slat and thiourea pigments or dyes. Such charge control agents are contained in amounts preferably ranging from 0.5 to 10 parts, more preferably from 1 to 5 parts, per 100 parts by weight of the sum of binder resin and magnetic particles. Illustrative release agents that can be used include polyolefins, aliphatic esters, higher aliphatic acids, higher alcohols, paraffin waxes, amide waxes, esters of polyhydric alcohols, etc. These release agents are preferably used in amounts ranging from 1 to 10 parts per 100 parts by weight of the sum of binder resin and magnetic particles.

The magnetic toner of which the one-component developer of the present invention is composed may be mixed with an external additive such as a fine inorganic powder or a cleanability improving aid after the resin particles have been spheroidized. Particularly preferred examples of the fine inorganic powder are the fine particles of metal or non-metal oxides. Specifically, silicon oxide, titanium oxide, aluminum oxide, cerium oxide, chromium oxide, strontium titanate, etc. may be used. These oxide compounds may be used either on their own or as admixtures.

The magnetic toner of which the one-component developer of the present invention is composed may be produced by the following procedure. First, a binder resin, magnetic particles and any other necessary additives are preliminarily mixed. Then, the mixture is kneaded while it is melted in a device such as an extruder. Thereafter, the melt is cooled, coarsely ground with a hammer mill, a Wiley grinding machine, etc., finely ground with a jet mill or some other device, and subsequently classified to obtain resin particles having a desired size. In the next step, these resin particles are subjected to a plastic spheroidizing process in a "Hybridization System" or the like by repeated application of mechanical energy under impact in a gas phase. The resulting magnetic toner is optionally mixed with external additives to produce a magnetic toner having improved characteristics.

The following examples are provided for the purpose of further illustrating the present invention but are in no way to be taken as limiting. Magnetic toner's recipe:

| Component | Parts by weight |
|---|---|
| Styrene-butyl acrylate copolymer (binder) | 50 |
| Magnetite (magnetic material) | 46 |
| "Nigrosine/SO" (Orient Chemical Industry Co., Ltd.) (additive) | 1 |
| Polypropylene wax | 3 |

Production process:

1) Premixing (in V-type blender)
2) Kneading (in extruder)
3) Cooling and coarse grinding
4) Fine grinding (in jet mill)
5) Classification
6) Spheroidization (plastic spheroidizing process)
7) Treatment with external additive (mixing with 0.8 parts by weight of hydrophobic fine silica particles).

EXAMPLE 1

Toner Sample No. 1 of the Present Invention

Using spherical magnetic particles (minor to major axis ratio≃0.96) with $D_{50}$ of about 0.3 μm, toner sample No. 1 of the present invention having a sphericity of 0.73 was prepared by the procedure described above.

EXAMPLE 2

Toner Sample No. 2 of the Present Invention

Using spherical magnetic particles (minor to major axis ratio≃0.96) with $D_{50}$ of about 0.3 μm, toner sample No. 2 of the present invention having a sphericity of 0.45 was prepared as in Example 1.

EXAMPLE 3

Toner Sample No. 3 of the Present Invention

Using spherical magnetic particles (minor to major axis ratio≃0.91) with $D_{50}$ of about 0.3 μm, toner sample No. 3 of the present invention having a sphericity of 0.60 was prepared as in Example 1.

Comparative Example 1

Comparative Toner Sample No. 1

The procedure of Example 1 was repeated except that irregularly shaped toner particles (minor to major axis ratio=0.85) with $D_{50}$ of about 0.3 μm were used.

In step 5) of the production process, bulk magnetic toner powders that had been classified to obtain $D_{50}$ in the range of 11.0–11.8 μm with no more than 1 wt % of small particles (≦5 μm) and with no more than 2 wt % of large particles (≧20 μm) were subjected to the plastic spheroidization process. The results are shown in Table 1 (table of particle size distribution).

Comparative Example 2

Comparative Toner Sample No. 2

The procedure of Example 1 was repeated except that step 6) of the production process was not performed. The resulting toner particles had a true sphericity of 0.37.

TABLE 1

| Sample | *$D_{50}$ (μm) | Under 5 μm (%) | Over 20 μm (%) |
|---|---|---|---|
| Toner No. 1 | 11.6 | 0.9 | 1.2 |
| Toner No. 2 | 12.0 | 0.8 | 0.5 |
| Toner No. 3 | 10.9 | 1.0 | 0.4 |
| Comparative toner No. 1 | 11.2 | 4.5 | 1.1 |
| Comparative toner No. 2 | 11.5 | 0.5 | 1.0 |

$D_{50}$: median diameter on a volume basis.

Evaluation

With a virgin OPC photo-receptor (drum) or a used (104 runs) OPC photoreceptor (drum) set on an electrophotographic copier Model LiPS-10 of C. Itoh Electronics Co., Ltd., copies were taken and evaluated visually for image quality, transfer efficiency, black solid density and toner scattering. The results are shown in Tables 2 and 3. The result shown in Table 2 refers to the overall rating after 500 runs on the virgin drum, except that the transfer efficiency is the average of 500 copies of line image. The result shown in Table 3 refers to the data obtained in the initial period of continuous copying operation with the used drum.

TABLE 2

| Sample | Black solid density | Character quality | Transfer efficiency, % | Toner scattering |
|---|---|---|---|---|
| Toner No. 1 | ○ | ○ | 95 | ○ |
| Toner No. 2 | ○ | ○ | 92 | ○ |
| Toner No. 3 | ○ | ○ | 96 | ○ |
| Comparative toner No. 1 | Δ | ○ | 70 | X |
| Comparative toner No. 2 | X | X | 60 | ○ |

TABLE 3

| Sample | Black solid density | character quality |
|---|---|---|
| Toner No. 1 | ○ | ○ |
| Toner No. 2 | ○ | ○ |
| Toner No. 3 | ○ | ○ |
| Comparative toner No. 1 | X | X |
| Comparative toner No. 2 | X | X |

The black solid density and character quality were evaluated by the following criteria:

Black Solid Density

○, adequate and uniform density;
Δ, density uneven but satisfactory for practical purposes:
×, density insufficient and uneven, with white streaks.

Character Quality

○, fine lines reproduced satisfactorily (without blocking of shadows, jumps or fogging);
×, character jumps and fogging When toner sample No. 1 of the present invention was used, a black solid density that was uniform and adequate and an unfogged sharp character image could be obtained with high transfer efficiency whether the photoreceptor drum was in a virgin or used state.

When comparative toner No. 1 was used on the virgin drum, characters could be reproduced faithfully without fogging. However, when it was subjected to a short running operation, free magnetic particles remained on the sleeve, leading to the formation of white streaks. Toner scattering also occurred.

After the developing unit and its nearby area where cleaned, a short running operation was performed. After 3 KP, the copying machine was found to have been fouled by the scattering toner particles.

Comparative sample No. 1 was also inferior to toner No. 1 of the present invention since the grinding action in the spheroidizing process caused unavoidable formation of irregularly shaped toner particles and the spherical toner particles obtained were insufficient to achieve high transfer efficiency.

The results with the used drum were short of practically acceptable levels already in the initial period of operation on account of either low black solid density or fogging. Comparative toner No. 2 which was irregular in particle shape had such a low fluidity that cavitation occurred in the developing unit to instabilize toner transport. Even with the virgin drum, the black solid density was both insufficient and uneven and character jumps occurred. The transfer efficiency was low. The results were worse with the used drum and image deterioration occurred. Whether the virgin or used drum was used, the results obtained with comparative toner No. 2 were short of practically acceptable levels already in the initial period of operation.

What is claimed is:

1. A magnetic toner produced by application of a spheroidizing treatment under mechanical impact force in a gas phase to resin particles containing at least magnetic particles in a resin, wherein said magnetic particles are substantially spherical in shape , have a minor axis to major axis ratio of at least 0.9, and said magnetic toner has a sphericity in the range of 0.4 to 0.8, as expressed by Wadell's true sphericity ($\Psi$).

2. A magnetic toner according to claim 1 wherein said resin particles contain a charge control agent.

3. A magnetic toner according to claim 2 wherein said charge control agent is contained in an amount of 0.5–10 parts by weight per 100 parts by weight of the sum of binder said resin and said magnetic particles.

4. A magnetic toner according to claim 1 wherein said resin particles contain a release agent.

5. A magnetic toner according to claim 4 wherein said release agent is contained in an amount of 1–10 parts by weight per 100 parts by weight of the sum of binder said resin and said magnetic particles.

6. A process for producing a magnetic toner comprising mixing at least a resin and substantially spherical magnetic particles to form a premix, kneading said premix as a melt, cooling said melt, grinding the cooled melt to form resulting particles, classifying said resulting particles, and spheroidizing said resulting particles by magnetic impact force in a gas phase, wherein said magnetic particles are substantially spherical in shape, have a minor axis to major axis ratio of at least 0.9, and said magnetic toner has a sphericity in the range of 0.4 to 0.8, as expressed by Wadell's true sphericity ($\Psi$).

7. A process according to claim 6 wherein a fine inorganic powder is added and mixed after the spheroidizing treatment.

* * * * *